US009670774B2

(12) United States Patent
Lee et al.

(10) Patent No.: US 9,670,774 B2
(45) Date of Patent: Jun. 6, 2017

(54) FLUID PRESSURE PULSE GENERATOR FOR A DOWNHOLE TELEMETRY TOOL

(71) Applicant: Evolution Engineering Inc., Calgary (CA)

(72) Inventors: Gavin Gaw-Wae Lee, Calgary (CA); Justin C. Logan, Calgary (CA); Aaron W. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 42 days.

(21) Appl. No.: 14/750,951

(22) Filed: Jun. 25, 2015

(65) Prior Publication Data

US 2015/0377018 A1 Dec. 31, 2015

Related U.S. Application Data

(60) Provisional application No. 62/018,409, filed on Jun. 27, 2014.

(51) Int. Cl.
*G01V 3/00* (2006.01)
*E21B 47/18* (2012.01)

(52) U.S. Cl.
CPC ..... *E21B 47/182* (2013.01)

(58) Field of Classification Search
CPC ..... E21B 47/18
USPC ..... 340/854.3
See application file for complete search history.

(56) References Cited

U.S. PATENT DOCUMENTS

| | | | |
|---|---|---|---|
| 3,302,457 | A | 2/1967 | Mayes |
| 3,309,656 | A | 3/1967 | Godbey |
| 3,764,968 | A | 10/1973 | Anderson |
| 3,958,217 | A | 5/1976 | Spinnler |
| 3,982,224 | A | 9/1976 | Patton |
| 4,351,037 | A | 9/1982 | Scherbatskoy |
| 4,641,289 | A | 2/1987 | Jürgens |
| 4,734,892 | A | 3/1988 | Kotlyar |
| 4,771,408 | A | 9/1988 | Kotlyar |
| 4,785,300 | A | 11/1988 | Chin et al. |
| 4,830,122 | A | 5/1989 | Walter |
| 4,847,815 | A | 7/1989 | Malone |
| 4,914,637 | A | 4/1990 | Goodsman |

(Continued)

FOREIGN PATENT DOCUMENTS

| | | | |
|---|---|---|---|
| CA | 1 228 909 | A | 11/1987 |
| CA | 1 229 998 | A | 12/1987 |

(Continued)

*Primary Examiner* — Nader Bolourchi
(74) *Attorney, Agent, or Firm* — Seed Intellectual Property Law Group LLP

(57) ABSTRACT

A fluid pressure pulse generator comprises a stator having a body with a cylindrical bore and a fluid flow chamber comprising a lateral opening and an uphole axial inlet, and a rotor having a cylindrical body rotatably seated within the bore, a rotor head connected to the rotor body, and a fluid diverter comprising a fluid passage through the rotor body and a nozzle in the rotor head. A fluid passage has an opening on an outside surface of the rotor body and an outlet at an end of the rotor body. The nozzle has an inlet end communicable with a drilling fluid and an outlet end in fluid communication with the fluid opening. The flow area of the nozzle increases from the inlet to outlet end such that the velocity of the drilling fluid slows while from inlet to outlet end.

9 Claims, 10 Drawing Sheets

(56) References Cited

U.S. PATENT DOCUMENTS

| | | | | |
|---|---|---|---|---|
| 4,953,595 | A | 9/1990 | Kotlyar | |
| 4,979,577 | A | 12/1990 | Walter | |
| 5,073,877 | A | 12/1991 | Jeter | |
| 5,079,750 | A | 1/1992 | Scherbatskoy | |
| 5,182,730 | A | 1/1993 | Scherbatskoy | |
| 5,182,731 | A | 1/1993 | Hoelscher et al. | |
| 5,215,152 | A | 6/1993 | Duckworth | |
| 5,237,540 | A | 8/1993 | Malone | |
| 5,249,161 | A | 9/1993 | Jones et al. | |
| 5,316,610 | A | 5/1994 | Tamaki et al. | |
| 5,396,965 | A | 3/1995 | Hall et al. | |
| 5,583,827 | A | 12/1996 | Chin | |
| 5,586,083 | A | 12/1996 | Chin et al. | |
| 5,586,084 | A | 12/1996 | Barron et al. | |
| 5,636,178 | A | 6/1997 | Ritter | |
| 5,740,126 | A * | 4/1998 | Chin | E21B 47/182 175/40 |
| 5,740,127 | A | 4/1998 | Van Steenwyk et al. | |
| 5,787,052 | A | 7/1998 | Gardner et al. | |
| 5,950,736 | A | 9/1999 | Goldstein | |
| 6,016,288 | A | 1/2000 | Frith | |
| 6,219,301 | B1 | 4/2001 | Moriarty | |
| 6,414,905 | B1 | 7/2002 | Owens et al. | |
| 6,469,637 | B1 | 10/2002 | Seyler et al. | |
| 6,626,253 | B2 | 9/2003 | Hahn et al. | |
| 6,714,138 | B1 | 3/2004 | Turner et al. | |
| 6,750,783 | B2 | 6/2004 | Rodney | |
| 6,850,463 | B2 | 2/2005 | Winnacker | |
| 6,867,706 | B2 | 3/2005 | Collette | |
| 6,898,150 | B2 | 5/2005 | Hahn et al. | |
| 6,970,398 | B2 | 11/2005 | Lavrut et al. | |
| 6,975,244 | B2 | 12/2005 | Hahn et al. | |
| 7,138,929 | B2 | 11/2006 | Jeffryes et al. | |
| 7,145,834 | B1 | 12/2006 | Jeter | |
| 7,180,826 | B2 | 2/2007 | Kusko et al. | |
| 7,230,880 | B2 | 6/2007 | Lehr | |
| 7,250,873 | B2 | 7/2007 | Hahn et al. | |
| 7,280,432 | B2 | 10/2007 | Hahn et al. | |
| 7,319,638 | B2 | 1/2008 | Collette | |
| 7,327,634 | B2 | 2/2008 | Perry et al. | |
| 7,330,397 | B2 | 2/2008 | Ganesan et al. | |
| 7,367,229 | B2 | 5/2008 | Engström | |
| 7,400,262 | B2 | 7/2008 | Chemali et al. | |
| 7,405,998 | B2 | 7/2008 | Webb et al. | |
| 7,417,920 | B2 | 8/2008 | Hahn et al. | |
| 7,468,679 | B2 | 12/2008 | Feluch | |
| 7,552,761 | B2 | 6/2009 | Moriarty | |
| 7,564,741 | B2 | 7/2009 | Pratt et al. | |
| 7,719,439 | B2 | 5/2010 | Pratt et al. | |
| 7,735,579 | B2 | 6/2010 | Gopalan et al. | |
| 7,808,859 | B2 | 10/2010 | Hahn et al. | |
| 7,839,719 | B2 | 11/2010 | Dopf et al. | |
| 7,881,155 | B2 | 2/2011 | Close | |
| 8,151,905 | B2 | 4/2012 | Song | |
| 8,174,929 | B2 | 5/2012 | Camwell et al. | |
| 8,203,908 | B2 | 6/2012 | Pratt et al. | |
| 8,251,160 | B2 | 8/2012 | Gopalan et al. | |
| 2009/0038851 | A1 | 2/2009 | Camwell et al. | |
| 2009/0280912 | A1 | 11/2009 | Buchanan et al. | |
| 2010/0212963 | A1 | 8/2010 | Gopalan et al. | |
| 2011/0005835 | A1 | 1/2011 | Li | |
| 2012/0085583 | A1 | 4/2012 | Logan et al. | |
| 2012/0127829 | A1 | 5/2012 | Sitka | |
| 2012/0195442 | A1 | 8/2012 | Villemoes et al. | |

FOREIGN PATENT DOCUMENTS

| | | | |
|---|---|---|---|
| CA | 2 506 808 | C | 10/2010 |
| CA | 2 551 316 | C | 1/2012 |
| CA | 2 855 940 | A1 | 6/2013 |
| GB | 2457175 | B | 5/2011 |
| WO | 94/05893 | A1 | 3/1994 |
| WO | 2005/084281 | A2 | 9/2005 |
| WO | 2006/130606 | A2 | 12/2006 |
| WO | 2007/033126 | A2 | 3/2007 |
| WO | 2009/033146 | A2 | 3/2009 |
| WO | 2010/138961 | A2 | 12/2010 |
| WO | 2012/027245 | A1 | 3/2012 |
| WO | 2012/027633 | A2 | 3/2012 |
| WO | 2012/130936 | A1 | 10/2012 |
| WO | 2012/145637 | A2 | 10/2012 |
| WO | 2014/071514 | A1 | 5/2014 |

* cited by examiner

FLUID PRESSURE PULSE GENERATOR FOR A DOWNHOLE TELEMETRY TOOL

BACKGROUND

Technical Field

This invention relates generally to a fluid pressure pulse generator for a downhole telemetry tool, such as a mud pulse telemetry measurement-while-drilling ("MWD") tool.

Description of the Related Art

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight drill collars. The BHA is conveyed into the wellbore by a string of metallic tubulars (i.e., drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

One type of downhole MWD telemetry known as mud pulse telemetry involves creating pressure waves ("pulses") in the drill mud circulating through the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulse or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Some valves are hydraulically powered to reduce the required actuation power typically resulting in a main valve indirectly operated by a pilot valve. The pilot valve closes a flow restriction which actuates the main valve to create a pressure drop. Pulse frequency is typically governed by pulse generator motor speed changes. The pulse generator motor requires electrical connectivity with the other elements of the MWD probe.

One type of valve mechanism used to create mud pulses is a rotor and stator combination wherein a rotor can be rotated between an opened position (no pulse) and a closed position (pulse) relative to the stator. Although the drilling mud is intended to pass through the rotor openings, some mud tends to flow through other gaps in the rotor/stator combination; such "leakage" tends to reduce the resolution of the telemetry signal as well as cause erosion in parts of the telemetry tool. One factor that appears to contribute to leakage and erosion is the velocity of drilling mud that flows into the rotor and stator combination.

BRIEF SUMMARY

According to one aspect of the invention, there is provided a fluid pressure pulse generator apparatus for a downhole telemetry tool comprises a stator and a rotor. The stator has a stator body with a cylindrical central bore and at least one fluid flow chamber comprising a lateral opening and an uphole axial inlet. The rotor comprises a cylindrical rotor body at least partially rotatably seated within the central bore, a rotor head connected to an uphole end of the rotor body, and a fluid diverter comprising a fluid passage through the rotor body and at least one nozzle in the rotor head. At least one fluid passage has at least one fluid opening on an outside surface of the rotor body and an axial outlet at a downhole end of the rotor body. The at least one nozzle has an inlet end fluidly communicable with a drilling fluid and an outlet end in fluid communication with the at least one fluid opening. The cross-sectional flow area of the at least one nozzle increases from the inlet end to the outlet end such that the velocity of the drilling fluid slows while flowing from the inlet end to the outlet end of the at least one nozzle. The rotor can be rotated relative to the stator such that the fluid diverter is movable in and out of fluid communication with the at least one fluid flow chamber to create fluid pressure pulses in the drilling fluid flowing through the pulse generator.

The rotor head can have a frusto-conical shape with an uphole end of the rotor head having a larger diameter than an downhole end of the rotor head, such that single nozzle is defined having an annular cross sectional flow area circumscribing the rotor head portion. The diameter of the downhole end of the rotor head can be smaller than the diameter of the rotor body such that an annular rim is defined at the intersection of the rotor head and rotor body, and the at least one fluid opening can have an end portion in the rim that is in fluid communication with the nozzle outlet end.

The rotor head can have a cylindrical shape with the same diameter as the rotor body, and can comprise a plurality of nozzles spaced circumferentially around the rotor head. Each of the plurality of nozzles can comprise an inlet end and an outlet end; a depth of the nozzle can increase from the inlet end to the outlet end. Each nozzle can also have a width which decreases from the inlet end to the outlet end.

The at least one fluid opening can have a longitudinal portion extending along the surface of the rotor body. The fluid diverter of the rotor can comprise four fluid openings spaced circumferentially around the rotor body, and the stator can comprise four full fluid flow chambers spaced circumferentially around the stator body, and four intermediate fluid flow chambers spaced circumferentially around the stator body, such that the four rotor fluid openings can align with the four intermediate fluid flow chambers to produce an intermediate fluid pressure pulse and can align with the four full fluid flow chambers to produce no fluid pressure pulse, and can align with none of the fluid flow chamber to produce a full fluid pressure pulse.

The rotor body can further comprise an annular fluid barrier extending circumferentially around the rotor body; the diameter of the annular fluid barrier is less than the diameter of the stator central bore.

BRIEF DESCRIPTION OF THE DRAWINGS

FIG. 6(*b*) a perspective view of the rotor/stator combination of FIG. 6 in intermediate flow configuration.

FIG. 6(*c*) is a perspective view of the rotor/stator combination of FIG. 6 in reduced flow configuration.

DETAILED DESCRIPTION

Directional terms such as "uphole" and "downhole" are used in the following description for the purpose of providing relative reference only, and are not intended to suggest any limitations on how any apparatus is to be positioned during use, or to be mounted in an assembly or relative to an environment. The embodiments described herein generally relate to a MWD tool having a fluid pressure pulse generator that can generate pressure pulses of different amplitudes ("pulse heights"). The fluid pressure pulse generator may be used for mud pulse ("MP") telemetry used in downhole drilling, wherein a drilling fluid (herein referred to as "mud") is used to transmit telemetry pulses to surface. The fluid pressure pulse generator may alternatively be used in other methods where it is necessary to generate a fluid pressure pulse. The fluid pressure pulse generator comprises a stator fixed to the rest of the tool or the drill collar and a rotor rotatable relative to the stator and coupled to a motor in the tool. The rotor comprises a head shaped as a single nozzle or comprising multiple distinct nozzles that direct mud flowing downhole and outside of the rotor through fluid openings in the rotor 60. The nozzles each have a geometry which reduces the velocity of the mud as it flows into the rotor, which is expected to reduce the erosion of parts in the fluid pressure pulse generator and leakage between the rotor and the stator.

Figure 1:
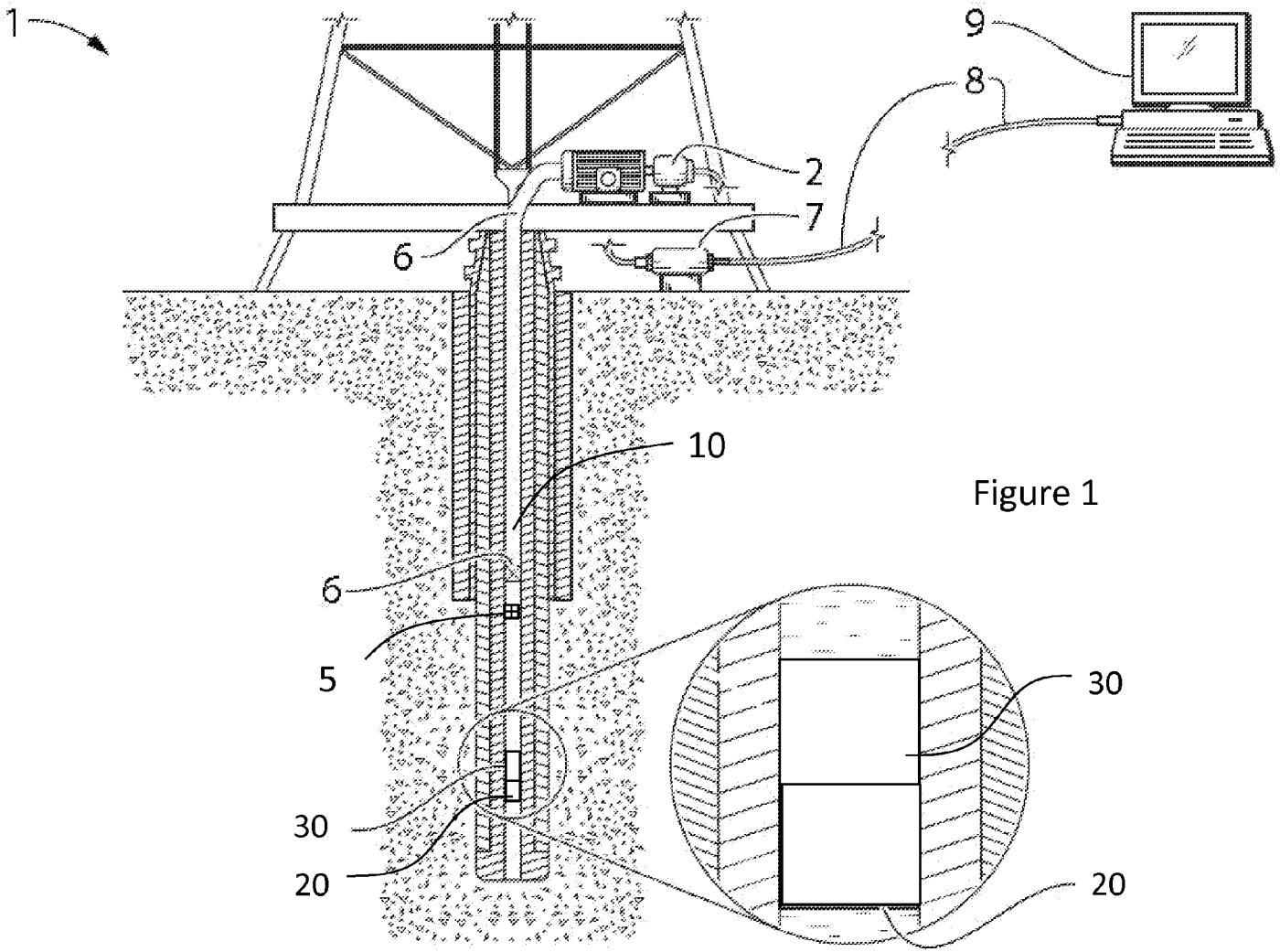
FIG. 1 is a schematic of a drill string in an oil and gas borehole comprising a MWD telemetry tool in accordance with embodiments of the invention.

Referring to the drawings and specifically to FIG. 1, there is shown a schematic representation of a MP telemetry operation using a fluid pressure pulse generator. In downhole drilling equipment 1, drilling mud is pumped down a drill string by pump 2 and passes through a measurement while drilling ("MWD") tool 20. The MWD tool 20 includes a fluid pressure pulse generator 30 (shown in FIG. 2) according to embodiments of the invention. The fluid pressure pulse generator 30 has a reduced flow configuration which generates full positive pressure pulses (represented schematically as block 6 in a mud column 10), an intermediate flow configuration which generates an intermediate positive pressure pulse (represented schematically as block 5 in the mud column 10), and a full flow configuration in which mud flows relatively unimpeded through the pressure pulse generator 30 and no pressure pulse is formed. Intermediate pressure pulse 5 is smaller compared to the full pressure pulse 6. Information acquired by downhole sensors (not shown) is transmitted in specific time divisions by the pressure pulses 5, 6 in the mud column 10. More specifically, signals from sensor modules in the MWD tool 20 or in another downhole probe (not shown) communicative with the MWD tool 20 are received and processed in a data encoder in the MWD tool 20 where the data is digitally encoded as is well established in the art. This data is sent to a controller in the MWD tool 20 which then actuates the fluid pressure pulse generator 30 to generate pressure pulses 5, 6 which contain the encoded data. The pressure pulses 5, 6 are transmitted to the surface and detected by a surface pressure transducer 7 and decoded by a surface computer 9 communicative with the transducer by cable 8. The decoded signal can then be displayed by the computer 9 to a drilling operator.

The characteristics of the pressure pulses 5, 6 are defined by amplitude, duration, shape, and frequency and these characteristics are used in various encoding systems to represent binary data. The ability of the pressure pulse generator 30 to produce two different sized pressure pulses 5, 6, allows for greater variation in the binary data being produced and therefore provides quicker and more accurate interpretation of downhole measurements.

Figure 2:
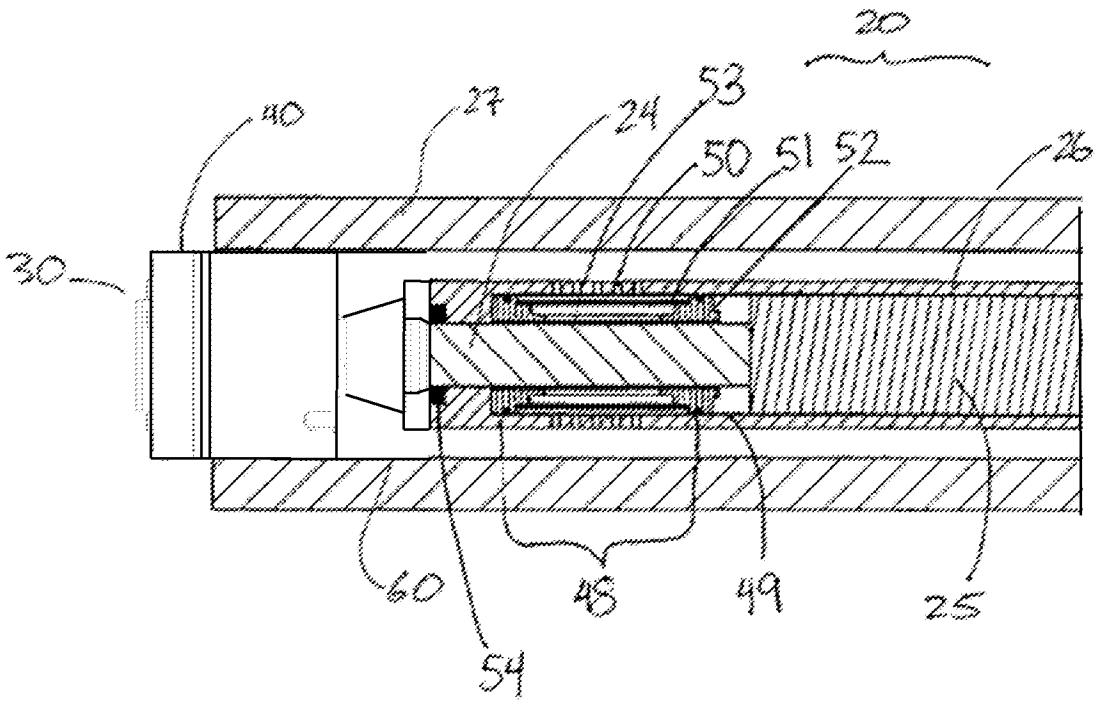
FIG. 2 is a longitudinally sectioned view of a mud pulser section of the MWD tool showing a fluid pressure pulse generator.

Referring to FIG. 2, the MWD tool 20 is shown in more detail. The MWD tool 20 generally comprises the fluid pressure pulse generator 30 which creates the fluid pressure pulses, and a pulser assembly 26 which takes measurements while drilling and which drives the fluid pressure pulse generator 30; the pulse generator 30 and pulser assembly 26 are axially located inside a drill collar (not shown) with an annular channel therebetween to allow mud to flow through the channel. The fluid pressure pulse generator 30 generally comprises a stator 40 and a rotor 60. The stator 40 is fixed to a landing sub 27 and the rotor 60 is fixed to a drive shaft 24 of the pulser assembly 26. The pulser assembly 26 is fixed to the drill collar. The pulser assembly 26 includes a pulse generator motor subassembly 25 and an electronics subassembly (not shown) electronically coupled together but fluidly separated by a feed-through connector (not shown). The motor subassembly 25 includes a pulse generator motor housing 49 which houses components including a pulse generator motor (not shown), gearbox (not shown), and a pressure compensation device 48. The electronics subassembly includes an electronics housing which is coupled to an end of the pulse generator motor housing 49 and which houses downhole sensors, control electronics, and other components (not shown) required by the MWD tool 20 to determine the direction and inclination information and to take measurements of drilling conditions, to encode this telemetry data using one or more known modulation techniques into a carrier wave, and to send motor control signals to the pulse generator motor to rotate the drive shaft 24 and rotor 60 in a controlled pattern to generate pressure pulses 5, 6 representing the carrier wave for transmission to surface.

The motor subassembly 25 is filled with a lubricating liquid such as hydraulic oil or silicon oil; this lubricating liquid is fluidly separated from the mud flowing through the pulse generator 30; however, the pressure compensation device 48 comprises a flexible membrane 51 in fluid communication with both the mud and the lubrication liquid, which allows the pressure compensation device 48 to maintain the pressure of the lubrication liquid at about the same pressure as the drilling mud at the pulse generator 30.

The fluid pressure pulse generator 30 is located at the downhole end of the MWD tool 20. Drilling mud pumped from the surface by pump 2 flows through an annular channel 55 between the outer surface of the pulser assembly 26 and the inner surface of the landing sub 27. When the mud reaches the fluid pressure pulse generator 30 it is diverted into a hollow portion of the rotor 60 through fluid openings 67 in the rotor 60 (see for example, FIG. 4(*a*)) and exits the rotor 60 via a discharge outlet, as will be described in more detail below with reference to FIGS. 3 to 5. The stator 40 is provided with different sized chambers that can be aligned with the rotor's fluid openings 67 to provide different flow geometries for the fluid flow through the fluid pressure pulse generator 30. More particularly, the rotor 60 can be rotationally positioned relative to the stator 40 to form three different flow configurations wherein the fluid flow geometry is different in each flow configuration, thereby creating different height pressure pulses 5, 6 that are transmitted to the surface, or allowing mud to flow freely through the fluid pressure pulse generator 30 resulting in no pressure pulse.

Figure 3:
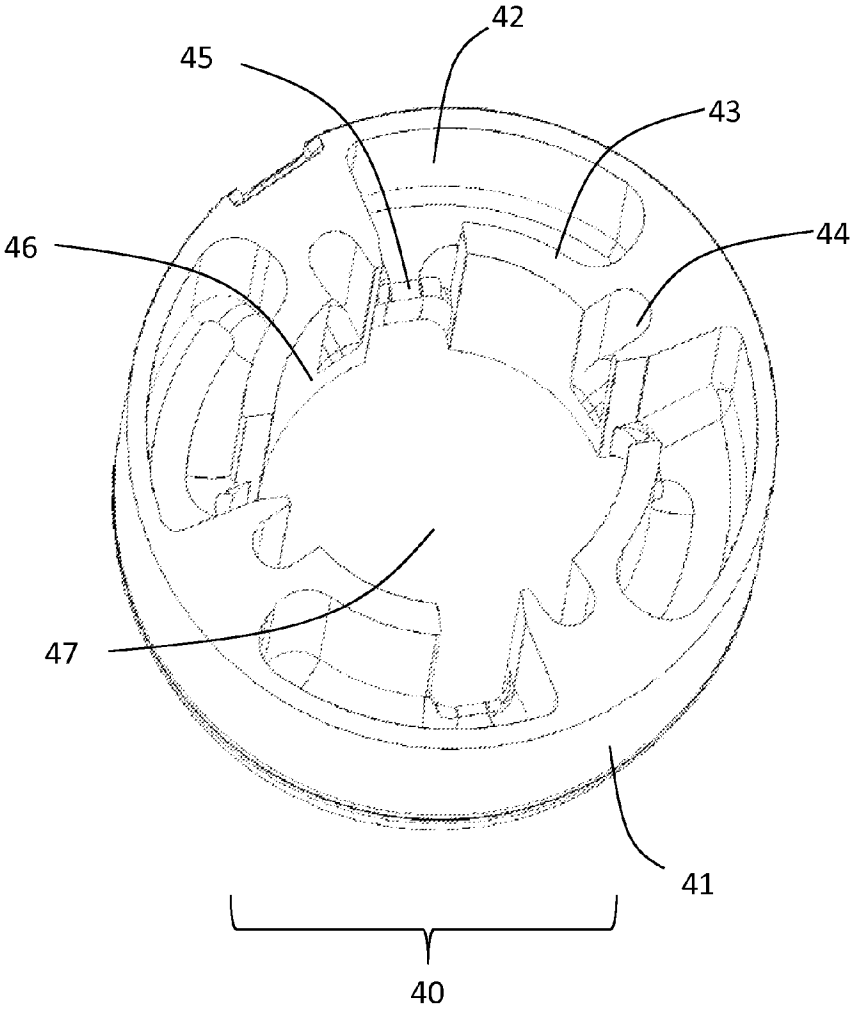
FIG. 3 is a perspective view of a stator of a fluid pressure pulse generator.
Figure 4A:
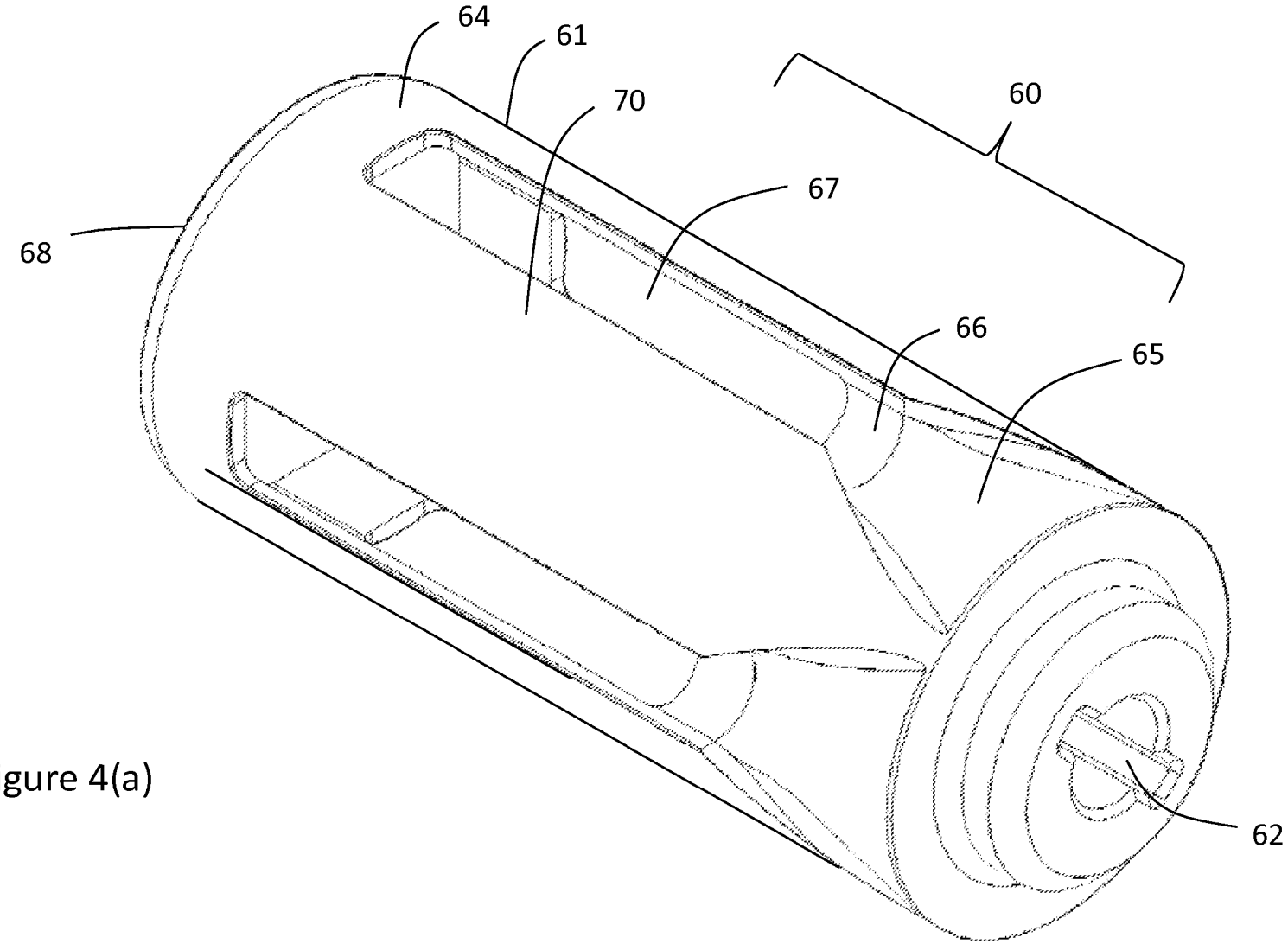
FIGS. 4(*a*)-(*c*) are perspective, side and front views of a rotor of the fluid pressure pulse generator according to a first embodiment.
Figure 4C:
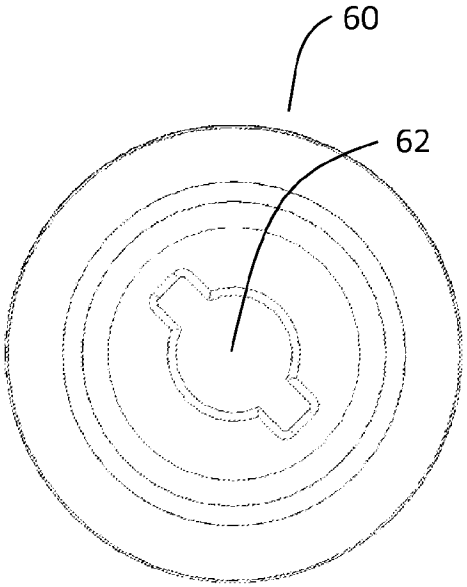
Figure 4B:
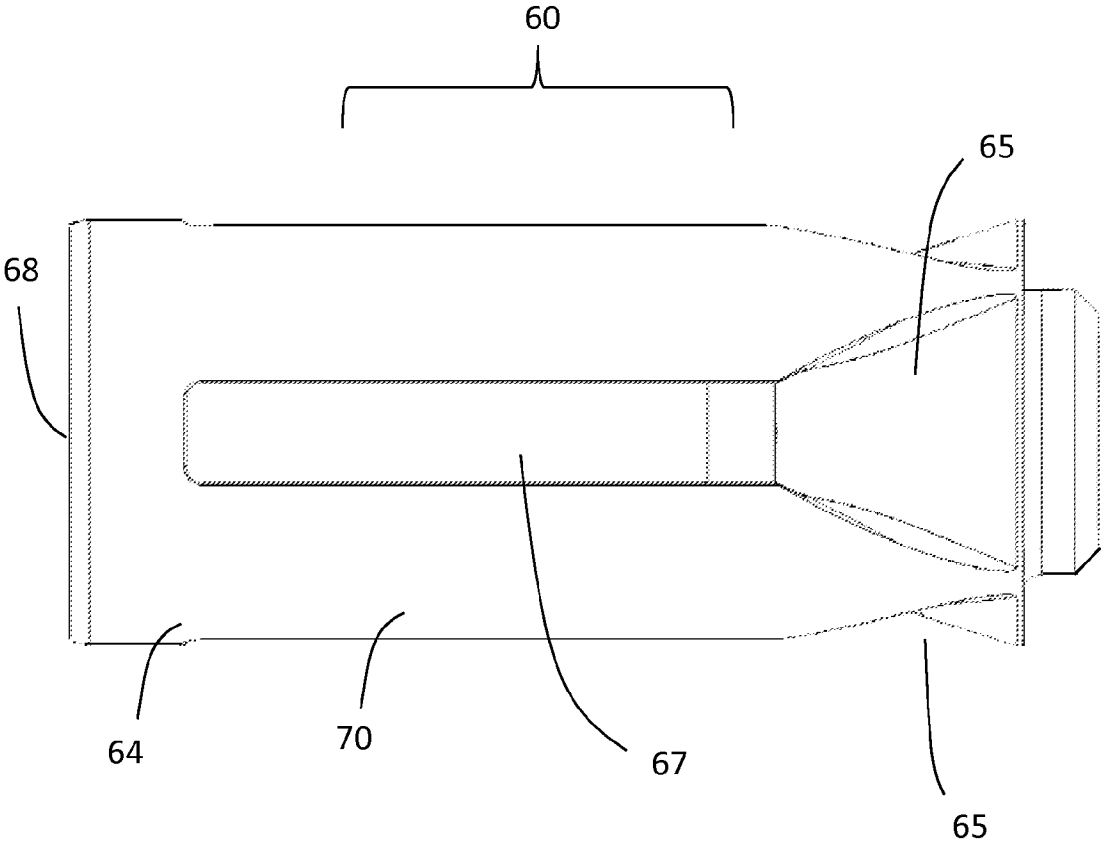

Referring now to FIGS. 3 and 4(*a*) to (*c*) and according to a first embodiment, there is shown the stator 40 and rotor 60 which combine to form the fluid pressure pulse generator 30. The rotor 60 comprises a generally cylindrical body 61 with a downhole end ("tail") an uphole end ("head"). The cylindrical surface of the body 61 has four equidistant and circumferentially spaced rectangular fluid openings 67 separated by four equidistant and circumferentially spaced leg sections 70, and a mud-lubricated journal bearing ring section 64 that circumscribes the tail end of the body 61 and defines a downhole axial discharge outlet 68 for discharging mud that has flowed into a hollow portion of the rotor 60 through the fluid openings 67; the fluid openings 67 are in fluid communication with the axial discharge outlet 68 and thus define a fluid passage for flow of drilling mud through the rotor body 61. The bearing ring section 64 helps centralize the rotor 60 in the stator 40 and provides structural strength to the leg sections 70. The diameter of the rotor body 61 is selected to match the diameter of the pulser assembly 26 to ensure a smooth flow of mud from the annular channel 55 and into the rotor 60.

A drive shaft receptacle 62 is located at the uphole end of the rotor 60. The drive shaft receptacle 62 is configured to receive and fixedly connect with the drive shaft 24 of the pulser assembly 26, such that in use the rotor 60 is rotated by the drive shaft 24. Four equidistant and circumferentially spaced nozzles 65 extend around the outside of the rotor head are each in fluid communication with one of the fluid openings 67. Each nozzle 65 comprises a wedge-shaped depression in the outer surface of the rotor body 61 and an axial channel outlet 66 at a downstream end of the depression. The depression is at its widest and shallowest at an upstream end, and has a width and depth which tapers generally linearly towards the downstream end, and is at its narrowest and deepest at the axial channel outlet 66. The channel outlet 66 of each nozzle 65 is aligned with a respective fluid opening 67 and together forms a fluid diverter of the rotor 60. In this embodiment there are four fluid diverters positioned equidistant and circumferentially around the rotor 60.

The nozzles 65 serve to direct mud flowing downhole through the annular channel 55 to the fluid openings 67 and into the rotor 60. The nozzles 65 each have a geometry which provides a smooth flow path from the annular channel 55 to the fluid openings 67 and which causes the velocity of mud to drop as the mud travels from the upstream end of the nozzle 65 to the axial channel outlet 66. In this embodiment, the nozzles 65 each have a depression with a slope that extends continuously and smoothly between a leading upstream edge of the depression (intersecting the outer surface of the rotor body 61) and the channel outlet 66, with the shallowest slope angle in the axial direction of the rotor 60; the deepest part of the nozzle 65 coincides with the bottom of the channel outlet 66. The geometry of the depression is selected such that the cross-sectional flow area nozzle increases from the upstream end to the downstream end of the nozzle. Although only one nozzle geometry is shown in the Figures, other geometries of the nozzles 65 can be selected depending on flow parameter requirements. The selected geometry of the nozzles 65 is intended to cause the mud velocity to slow in a controlled manner until a target mud velocity is reached at the fluid openings 67. The target velocity drop preferably should not be so great as to cause damage to the telemetry tool 20, yet should not be so small as to not materially reduce the rate of erosion of parts of the telemetry tool 20 that contact the flowing mud. In one embodiment, the geometry of the nozzles 65 are selected to cause mud flowing from the annular channel 55 to the rotor 60 at an entry velocity of 20 ft/s to slow down to between 10-12 ft/s at the channel outlet 66.

Figure 6A:
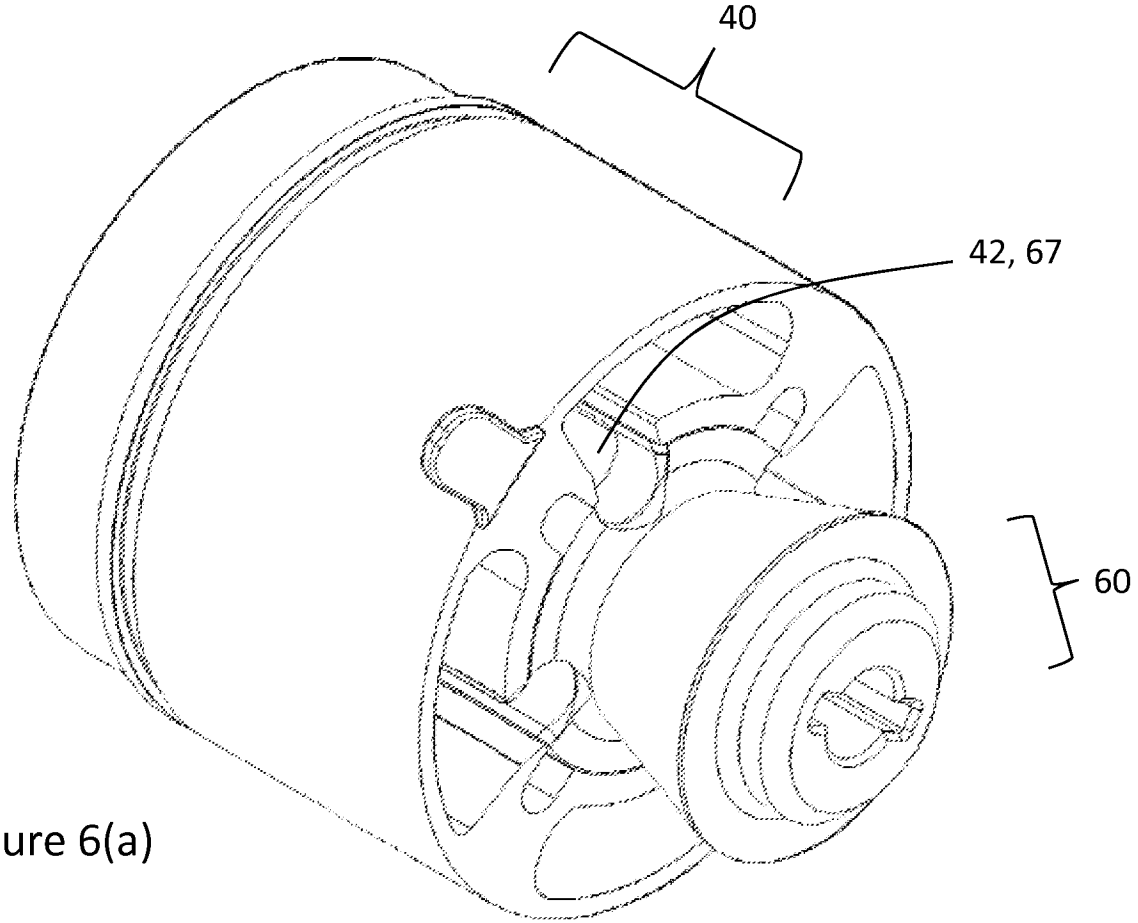
FIG. 6(*a*) is a perspective view of a combination of the stator and the second embodiment of the rotor shown in FIGS. 4(*a*)-(*c*) in full flow configuration.
Figure 6B:
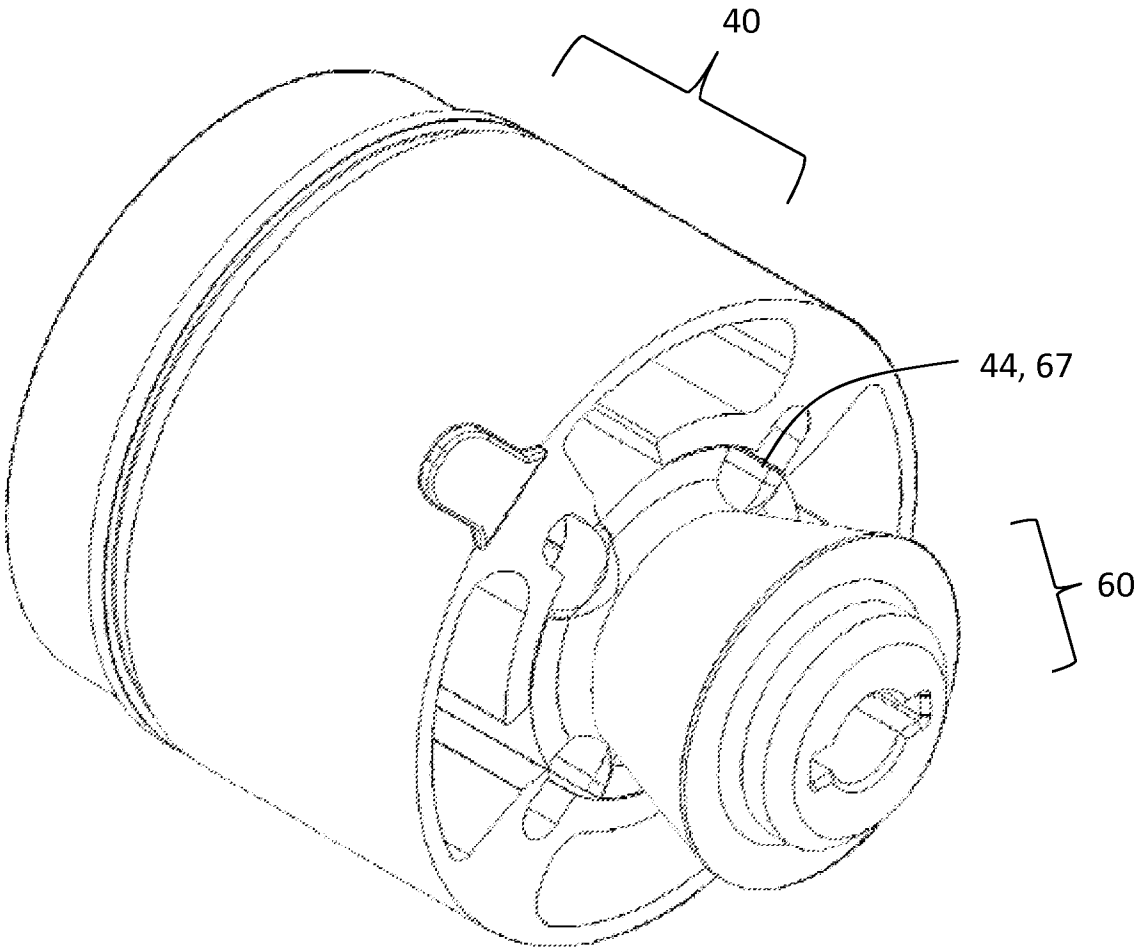
Figure 6C:
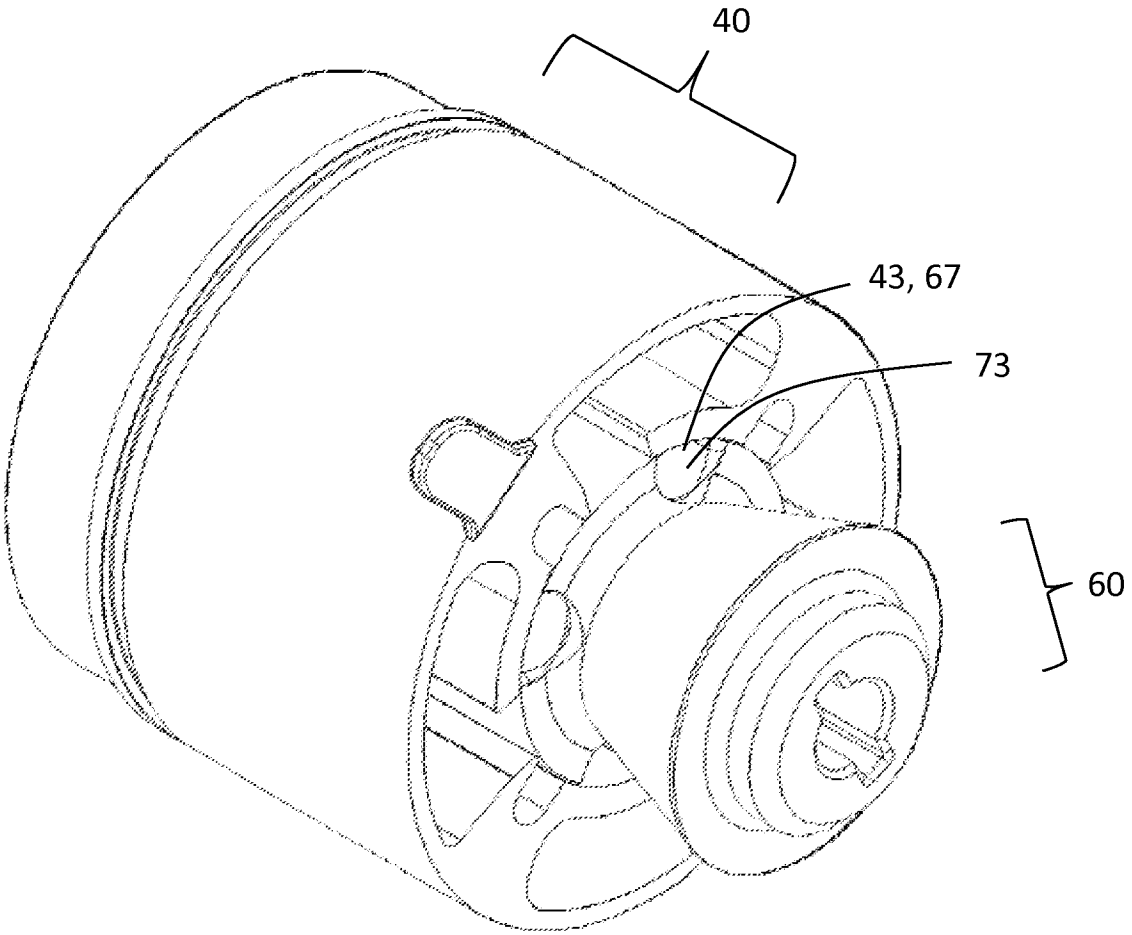

Referring particularly to FIG. 3, the stator 40 comprises a stator body 41 with a generally cylindrical central bore 47 therethrough dimensioned to receive the cylindrical body 61 of the rotor 60; the diameter of the central bore 47 is slightly larger than the diameter of the rotor body 61 to enable the rotor 60 to rotate relative to the stator 40. As a consequence, a small annular gap is formed between the walls of the stator central bore 47 and the rotor body 61. When the rotor body 61 is inserted into the central bore 47 (as shown in FIGS. 6(*a*) to (*c*)), the rotor head extends out of the stator body 41 such that the nozzles 65 are exposed to the flowing mud from the annular channel 55.

In this embodiment, the stator body 41 has an outer surface that is generally cylindrically shaped to enable the stator 40 to fit within a drill collar of a downhole drill string; however in alternative embodiments (not shown) the stator body 41 may be a different shape depending on where it is to be mounted, and for example it can be square-shaped, rectangular-shaped, or oval-shaped.

The stator body 41 includes four full flow chambers 42, four intermediate flow chambers 44 and four walled sections 43 in alternating arrangement around the stator body 41. In the embodiment shown in FIG. 3, the four full flow chambers 42 are "L" shaped and the four intermediate flow chambers 44 are "U" shaped, however in alternative embodiments (not shown) other configurations may be used for the chambers 42, 44. The geometry of the chambers is not critical provided the flow geometry of the chambers is conducive to generating the intermediate pulse 5 and no pulse in different flow configurations as described below in more detail. Each flow chamber 42, 44 has a lateral opening that opens into the central bore 47, as well as an axial inlet at the uphole end of the stator 40. The axial inlets and lateral openings of the full flow chambers 42 are substantially larger than the corresponding inlets and openings of the intermediate flow chambers 44. A solid bearing ring section 46 at the downhole end of the stator body 41 helps centralize the rotor 60 in the stator central bore 47 and minimizes flow of mud through the annular gap. The stator 40 can be considered to have four flow sections, which are positioned equidistant around the circumference of the stator 40, with each flow section having one of the intermediate flow chambers 44, one of the full flow chambers 42, and one of the wall sections 43. The full flow chamber 42 of each flow section is positioned between the intermediate flow chamber 44 and the walled section 43. In use, each of the four flow sections of the stator 40 interact with one of the four fluid diverters of the rotor 60. The rotor 60 is rotated in the fixed stator 40 to provide three different flow configurations as follows:

1. Full flow—where the rotor fluid openings 67 align with the stator full flow chambers 42, as shown in FIG. 6(*a*);
2. Intermediate flow—where the rotor fluid openings 67 align with the stator intermediate flow chambers 44, as shown in FIGS. 6(*b*); and
3. Reduced flow—where the rotor fluid openings 67 align with the stator walled sections 43, as shown in FIG. 6(*c*).

In the full flow configuration shown in FIG. 6(*a*), the lateral openings and axial inlets of the stator full flow chambers 42 align respectively with the fluid openings 67 and channel outlets 66 of the rotor 60, so that mud flows freely from the annular channel 55, into full flow chambers 42 and through the fluid openings 67. The flow area of the full flow chambers' lateral openings may correspond to the flow area of the rotor fluid openings 67. This corresponding sizing beneficially leads to no or minimal resistance in flow of mud through the fluid openings 67 when the rotor 60 is positioned in the full flow configuration. There should be zero pressure increase and no pressure pulse should be generated in the full flow configuration. The "L" shaped configuration of the full flow chambers 42 minimizes space requirement as each "L" shaped chamber tucks behind one of the walled sections 43 allowing for a compact stator design, which beneficially reduces production costs and results in less likelihood of blockage.

When the rotor 60 is positioned in the reduced flow configuration as shown in FIG. 6(*c*), there is no lateral flow opening in the stator 40 as the walled section 43 aligns with the fluid openings 67 of the rotor 60. Some mud is still diverted by the nozzles 65 into the stator central bore 47 through an axial gap 73 in fluid communication with the rotor's channel outlets 66; however, the total overall flow area through this axial gap 73 is substantially reduced compared to the total overall flow area in the full flow configuration. There is a resultant pressure increase causing the full pressure pulse 6.

In the intermediate flow configuration as shown in FIG. 6(*b*), the lateral openings and axial inlets of the intermediate flow chambers 44 align respectively with the fluid openings 67 and channel outlets 66 of the rotor 60, so that mud flows from the nozzles 65 into intermediate flow chambers 44 and through the fluid openings 67. The flow area of the intermediate flow chambers 44 is less than the flow area of the full flow chambers 42; therefore, the total overall flow area in the intermediate flow configuration is less than the total overall flow area in the full flow configuration, but more than the total overall flow area in the reduced flow configuration. As a result, the flow of mud through the fluid openings 67 in the intermediate flow configuration is less than the flow of mud through the fluid openings 67 in the full flow configuration, but more than the flow of mud through the fluid openings 67 in the reduced flow configuration. The intermediate pressure pulse 5 is therefore generated which is reduced compared to the full pressure pulse 6. The flow area of the intermediate flow chambers 44 may be one half, one third, one quarter the flow area of the full flow chambers 42, or any amount that is less than the flow area of the full flow chambers 42 to generate the intermediate pressure pulse 5 and allow for differentiation between pressure pulse 5 and pressure pulse 6.

When the rotor 60 is positioned in the reduced flow configuration as shown in FIG. 6(*c*), mud is still diverted by the nozzles 65 into the central bore 47 via the channel outlet 66 and axial gap 73; otherwise the pressure buildup would be detrimental to operation of the downhole drilling. In addition an axial bypass channel 48 is provided (see FIG. 3) at the downhole end of each full flow chamber 42 to assist in the flow of mud out of the fluid flow generator 30 regardless of the flow configuration.

With the exception of the axial bypass channel 48, each of the flow chambers 42, 44 are closed at the downhole end by a bottom face surface 45. The bottom face surface 45 of both the full flow chambers 42 and the intermediate flow chambers 44 may be angled in the downhole flow direction to assist in smooth flow of mud from chambers 42, 44 through the rotor fluid openings 67 in the full flow and intermediate flow configurations respectively, thereby reducing flow turbulence.

Provision of the intermediate flow configuration allows the operator to choose whether to use the reduced flow configuration, intermediate flow configuration or both configurations to generate pressure pulses depending on fluid flow conditions. The fluid pressure pulse generator 30 can operate in a number of different flow conditions. For higher fluid flow rate conditions, for example, but not limited to, deep downhole drilling or when the drilling mud is heavy or viscous, the pressure generated using the reduced flow configuration may be too great and cause damage to the system. The operator may therefore choose to only use the intermediate flow configuration to produce detectable pressure pulses at the surface. For lower fluid flow rate conditions, for example, but not limited to, shallow downhole drilling or when the drilling mud is less viscous, the pressure pulse generated in the intermediate flow configuration may be too low to be detectable at the surface. The operator may therefore choose to operate using only the reduced flow configuration to produce detectable pressure pulses at the surface. Thus it is possible for the downhole drilling operation to continue when the fluid flow conditions change without having to change the fluid pressure pulse generator 30. For normal fluid flow conditions, the operator may choose to use both the reduced flow configuration and the intermediate flow configuration to produce two distinguishable pressure pulses 5, 6, at the surface and increase the data rate of the fluid pressure pulse generator 30.

If one of the stator chambers (either full flow chambers 42 or intermediate flow chambers 44) is blocked or damaged, or one of the stator wall sections 43 is damaged, operations can continue, albeit at reduced efficiency, until a convenient time for maintenance. For example, if one or more of the stator wall sections 43 is damaged, the full pressure pulse 6 will be affected; however operation may continue using the intermediate flow configuration to generate intermediate pressure pulse 5. Alternatively, if one or more of the intermediate flow chambers 44 is damaged or blocked, the intermediate pulse 5 will be affected; however operation may continue using the reduced flow configuration to generate the full pressure pulse 6. If one or more of the full flow chambers 42 is damaged or blocked, operation may continue by rotating the rotor between the reduced flow configuration and the intermediate flow configuration. Although there will be no zero pressure state, there will still be a pressure differential between the full pressure pulse 6 and the intermediate pressure pulse 5 which can be detected and decoded on the surface until the stator can be serviced. Furthermore, if one or more of the rotor fluid openings 67 is damaged or blocked which results in one of the flow configurations not being usable, the other two flow configurations can be used to produce a detectable pressure differential. For example, damage to one of the rotor fluid openings 67 may result in an increase in fluid flow through the rotor such that the intermediate flow configuration and the full flow configuration do not produce a detectable pressure differential, and the reduced flow configuration will need to be used to get a detectable pressure pulse.

Provision of multiple rotor fluid openings 67 and multiple stator chambers 42, 44 and wall sections 43, provides redundancy and allows the fluid pressure pulse generator 30 to continue working when there is damage or blockage to one of the rotor fluid openings 67 and/or one of the stator chambers 42, 44 or wall sections 43. Cumulative flow of mud through the remaining undamaged or unblocked rotor fluid openings 67 and stator chambers 42, 44 still results in generation of detectable full or intermediate pressure pulses 5, 6, even though the pulse heights may not be the same as when there is no damage or blockage.

It is evident from the foregoing that while the embodiment shown in FIG. 4 utilize four fluid openings 67 together with four full flow chambers 42, four intermediate flow chambers 44 and four wall sections 43 in the stator, different numbers of rotor fluid openings 67, stator flow chambers 42, 44 and stator wall sections 43 may be used. Provision of more fluid openings 67, chambers 42, 44 and wall section 43 beneficially reduces the amount of rotor rotation required to move between the different flow configurations, however, too many openings 67, chambers 42, 44 and wall section 43 may decrease the stability of the rotor and/or stator and may result in a less compact design thereby increasing production costs. Furthermore, the number of rotor fluid openings 67 need not match the number of stator flow chambers 42, 44 and stator wall sections 43. Different combinations may be utilized according to specific operation requirements of the fluid pressure pulse generator. In alternative embodiments (not shown) the intermediate flow chambers 44 need not be present or there may be additional intermediate flow chambers present that have a flow area less than the flow area of full flow chambers 42. The flow area of the additional intermediate flow chambers may vary to produce additional intermediate pressure pulses and increase the data rate of the fluid pressure pulse generator 30. The innovative aspects of the invention apply equally in embodiments such as these.

It is also evident from the foregoing that while the embodiment shown in FIG. 4 utilizes fluid openings in the rotor 60 and flow chambers in the stator 40, in alternative embodiments (not shown) the fluid openings may be positioned in the stator 40 and the flow chambers may be present in the rotor 60. In these alternative embodiments the rotor 60 still rotates between full flow, intermediate flow and reduced flow configurations whereby the fluid openings in the stator 40 align with full flow chambers, intermediate flow chambers and wall sections of the rotor respectively. The innovative aspects of the invention apply equally in embodiments such as these.

Figure 5A:
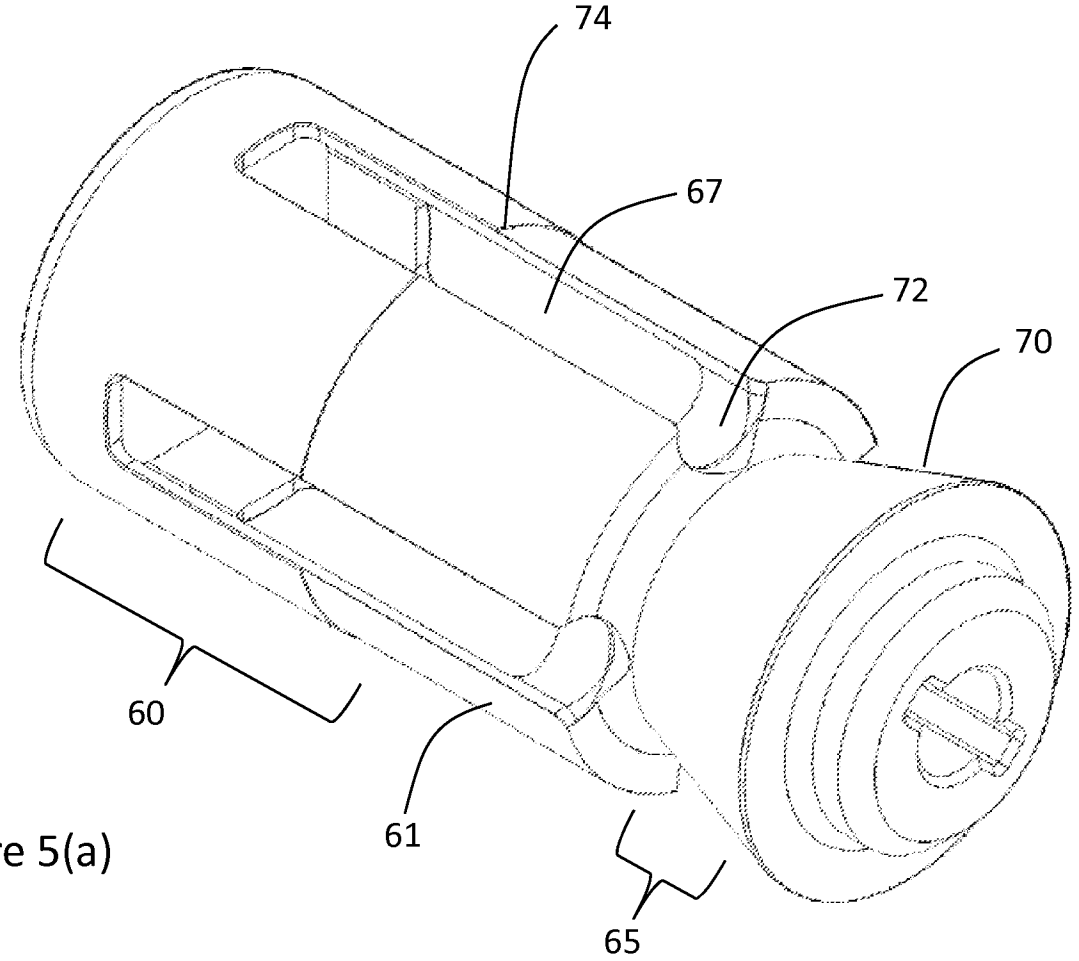
FIGS. 5(*a*)-(*c*) are perspective, side and front views of a rotor of the fluid pressure pulse generator according to a second embodiment.
Figure 5C:
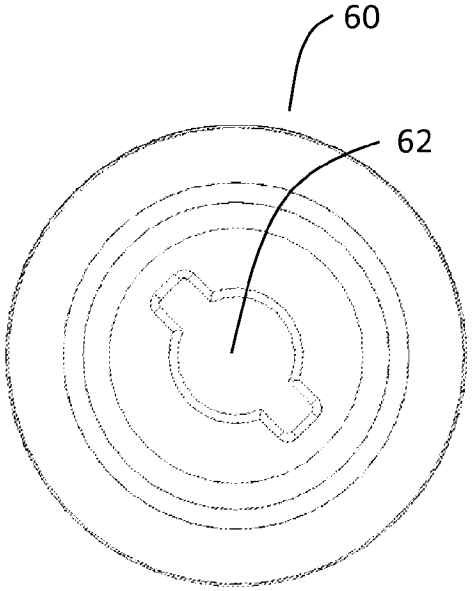
Figure 5B:
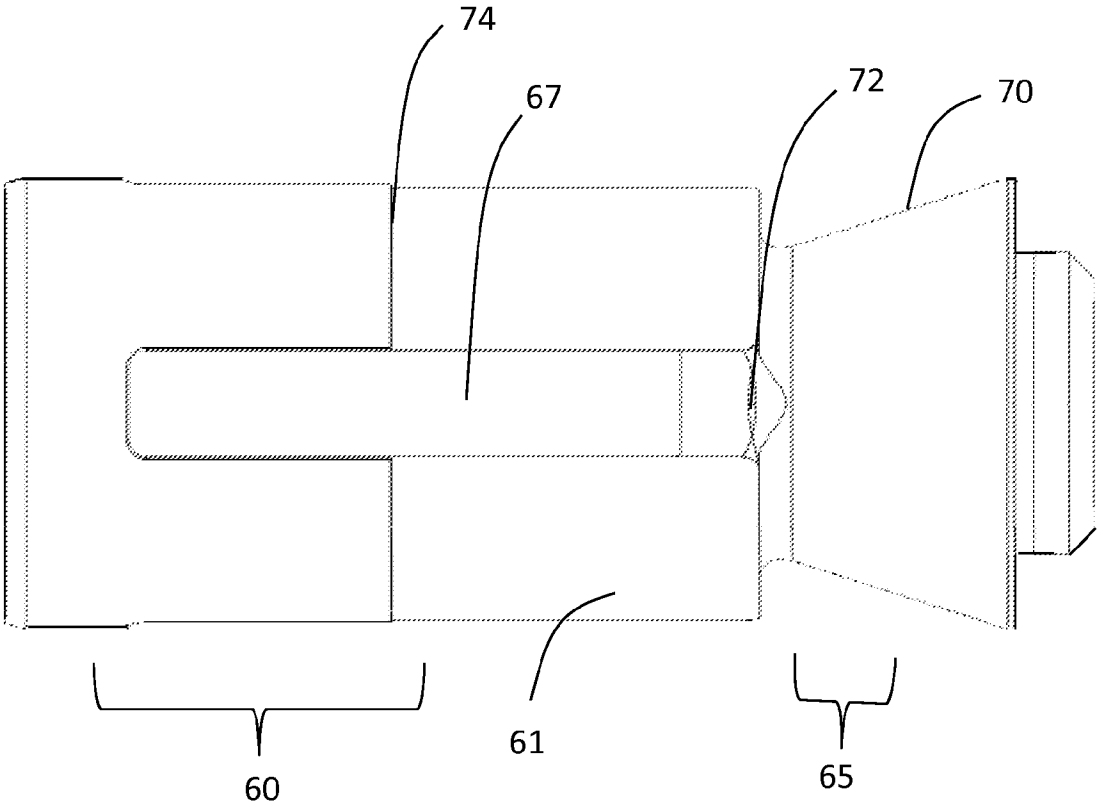

Referring now to FIGS. 5(*a*) to (*c*) and according to a second embodiment, the four wedge-shaped nozzles 65 are replaced by a tapered rotor head 70 that in effect serves as a single nozzle 65 to direct mud into the fluid openings 67. The tapered rotor head 70 has a frusto-conical shape with its largest diameter at the uphole end of the rotor 60 and its smallest diameter at the intersection of the rotor head 70 and the rotor body 61. In this embodiment, the largest diameter of the rotor head 70 matches the diameter of the rotor body 61 as well as the diameter of the pulser assembly 26. However, the largest diameter of the rotor head 70 can be different than the rotor body 61 diameter in other embodiments. The diameter of the downhole end of the rotor head 70 is smaller than the diameter of the rotor body 61, and thus an annular rim is defined at the intersection of the rotor head 70 and the rotor body 61. Each fluid opening 67 has a longitudinally extending portion along the surface of the rotor body 61, and an end portion 72 in the rim, which is fluid communication with the outlet end of the nozzle 65.

The rotor head 70 has a taper angle which can be the same as the taper angle of the floor of each nozzle 65 in the first embodiment. Like the first embodiment, the taper angle is selected so that the cross sectional flow area of the nozzle 65 increases in the axial direction from the uphole end of the rotor head 70 to the downhole end thereof, thereby causing mud flowing past the rotor head 70 to slow down. Whereas in the first embodiment, each nozzle has its own distinct cross sectional flow area, the cross sectional flow area in this embodiment is embodied as a single annular ring that increases in thickness towards the downstream end of the nozzle 65. The geometry of the rotor head 70 is selected so that the mud velocity is slowed from an entry velocity at the uphole end of the rotor head 70 to a target velocity at the axial inlet end 72 of the fluid openings 67.

In this embodiment, the rotor 60 comprises a generally cylindrical body having an uphole portion and a downhole portion wherein the uphole portion has a smaller diameter than that of the downhole portion, such that an annular lip 74 ("annular fluid barrier") is formed at the intersection of the two uphole and downhole portions. The annular fluid barrier serves to impede the flow of mud that has leaked through the annular gap between the upper portion of the rotor body 61 and the stator 40 from flowing further downhole through the annular gap, and instead divert this mud into the fluid openings 67 of the rotor 60. Such annular fluid barrier is an optional feature in this second embodiment, and also can be optionally incorporated into the first embodiment of the rotor 50 (not shown).

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fluid pressure pulse generator apparatus for a downhole telemetry tool comprising:

(a) a stator having a stator body with a cylindrical central bore and at least one fluid flow chamber comprising a lateral opening and an uphole axial inlet; and (b) a rotor comprising a cylindrical rotor body at least partially rotatably seated within the cylindrical central bore, a rotor head connected to an uphole end of the cylindrical rotor body, and a fluid diverter comprising a fluid passage through the cylindrical rotor body and at least one nozzle in the rotor head;

wherein the fluid passage has at least one fluid opening on an outside surface of the cylindrical rotor body, the at least one fluid opening extending into a hollow portion of the rotor, and an axial outlet at a downhole end of the rotor body, and the at least one nozzle has an inlet end fluidly communicable with a drilling fluid and an outlet end in fluid communication with the at least one fluid opening, wherein the cross-sectional flow area of the at least one nozzle increases from the inlet end to the outlet end such that the velocity of the drilling fluid slows while flowing from the inlet end to the outlet end of the at least one nozzle; and wherein the rotor can be rotated relative to the stator such that the fluid diverter is movable in and out of fluid communication with the at least one fluid flow chamber to create fluid pressure pulses in the drilling fluid flowing through the fluid pressure pulse generator.

2. An apparatus as claimed in claim 1 wherein the rotor head has a frusto-conical shape with an uphole end of the rotor head having a larger diameter than an downhole end of the rotor head, such that a single nozzle is defined having an annular cross sectional flow area circumscribing the rotor head.

3. An apparatus as claimed in claim 2 wherein the diameter of the downhole end of the rotor head is smaller than the diameter of the cylindrical rotor body such that an annular rim is defined at the intersection of the rotor head and cylindrical rotor body, and the at least one fluid opening has an end portion in the rim that is in fluid communication with the single nozzle outlet end.

4. An apparatus as claimed in claim 1 wherein the rotor head has a cylindrical shape with the same diameter as the cylindrical rotor body, and comprises a plurality of nozzles spaced circumferentially around the rotor head.

5. An apparatus as claimed in claim 4 wherein each of the plurality of nozzles comprises an inlet end and an outlet end, and a depth of each of the plurality of nozzles increases from the inlet end of the nozzle to the outlet end of the nozzle.

6. An apparatus as claimed in claim 5 wherein each of the plurality of nozzles has a width which decreases from the inlet end to the outlet end.

7. An apparatus as claimed in claim 1 wherein the at least one fluid opening has a longitudinal portion extending along the surface of the cylindrical rotor body.

8. An apparatus as claimed in claim 7 wherein the fluid diverter of the rotor comprises four fluid openings spaced circumferentially around the cylindrical rotor body, and the stator comprises four full fluid flow chambers spaced circumferentially around the stator body, and four intermediate fluid flow chambers spaced circumferentially around the stator body, such that the four rotor fluid openings can align with the four intermediate fluid flow chambers to produce an intermediate fluid pressure pulse and can align with the four full fluid flow chambers to produce no fluid pressure pulse, and can align with none of the fluid flow chamber to produce a full fluid pressure pulse.

9. An apparatus as claimed in claim 1 wherein the cylindrical rotor body further comprises an annular fluid barrier extending circumferentially around the cylindrical rotor body, the diameter of the annular fluid barrier being less than the diameter of the stator cylindrical central bore.

* * * * *